US005685924A

United States Patent [19]

Larsen

[11] Patent Number: 5,685,924

[45] Date of Patent: Nov. 11, 1997

[54] CREEP RESISTANT GAMMA TITANIUM ALUMINIDE

[75] Inventor: Donald E. Larsen, N. Muskegon, Mich.

[73] Assignee: Howmet Research Corporation, Whitehall, Mich.

[21] Appl. No.: 506,208

[22] Filed: Jul. 24, 1995

[51] Int. Cl.[6] ..... C22C 14/00

[52] U.S. Cl. ..... 148/421; 420/418; 420/421

[58] Field of Search ..... 148/421; 420/421, 420/418

[56] References Cited

U.S. PATENT DOCUMENTS 2,703,278 3/1955 Finlay et al. .

2,750,271 6/1956 Lyon et al. ..... 75/5

2,819,194 1/1958 Herres et al. ..... 420/421

4,878,966 11/1989 Alheritiere et al. ..... 148/421

5,350,466 9/1994 Larsen, Jr. et al. ..... 148/421

FOREIGN PATENT DOCUMENTS 587637 11/1959 Canada ..... 420/419

*Primary Examiner*—John Sheehan

*Attorney, Agent, or Firm*—Edward J. Timmer

[57] ABSTRACT

Creep resistant gamma titanium alumninide comprising titanium in the range of about 55 to about 71 weight % and aluminum in the range of 29 to about 35 weight % by virtue of including oxygen intentionally in the composition in an effective amount to significantly increase the high temperature creep resistance of the alloy. The composition can include greater than about 800 ppm up to about 1500 ppm oxygen to this end.

15 Claims, 1 Drawing Sheet

CREEP RESISTANT GAMMA TITANIUM ALUMINIDE

FIELD OF THE INVENTION

The present invention relates to titanium aluminum alloys and, more particularly, to a gamma type titanium aluminide alloy having dramatically improved creep resistance at elevated temperature.

BACKGROUND OF THE INVENTION

The ongoing search for increased aircraft engine performance has prompted materials science engineers to investigate intermetallic compounds as potential replacement materials for nickel and cobalt based superalloys currently in widespread use for gas turbine engine hardware. Of particular interest over the past decade have been gamma and near gamma titanium aluminides as a result of their low density and relatively high modulus and strength at elevated temperatures.

U.S. Pat. No. 4 294 615 describes a titanium aluminide having a composition narrowly selected within broader prior titanium aluminide compositions to provide a combination of high temperature creep strength together with moderate room temperature ductility. The patent investigated numerous titanium aluminide compositions set forth in Table 2 thereof and discloses an optimized alloy composition wherein the aluminum content is limited to 34–36 weight % and wherein vanadium and carbon can be added in amounts of 0.1 to 4 weight % and 0.1 weight %, respectively. The '615 patent identifies V as an alloying element for improving low temperature ductility and Nb, Bi, and C as alloying elements for improving creep rupture resistance. If improved creep rupture life is desired, the alloy is forged and annealed at 1100 to 1200 degrees C. followed by aging at 815 to 950 degrees C.

U.S. Pat. No. 5 207 982 describes a titanium aluminide composition including one of B, Ge, or Si as an alloying element and high levels of one or more of Hf, Mo, Ta, and W as additional alloying elements to provide high temperature oxidation/corrosion resistance and high temperature strength.

U.S. Pat. No. 5 350 466 provides a creep resistant titanium aluminide composition having about 44 to about 49 atomic % Al, about 0.5 to about 4.0 atomic % Nb, about 0.25 to about 3.0 atomic % Mn, about 0.1 to less than about 1.0 atomic % W, about 0.1 to about 0.6 atoomic % Si, and the balance Ti. The heat treated microstructure comprises predominantly gamma TiAl and at least one additional phase bearing at least one of W, Mo, abd Si dispersed intergranularly.

An object of the present invention is to provide a titanium aluminum alloy, as well as article and method of making same, with oxygen content controlled in a range discovered to unexpectedly and significantly increase the creep resistance at elevated temperature.

SUMMARY OF THE INVENTION

The present invention provides in one embodiment a predominantly gamma titanium aluminum alloy including a controlled, relatively high oxygen content effective to increase high temperature creep resistance of the alloy.

The present invention provides in another embodiment a titanium aluminum alloy comprising titanium in the range of about 55 to about 71 weight % and aluminum in the range of about 29 to about 35 weight % wherein oxygen is intentionally included in the composition in an amount, such as greater than about 800 parts per million by weight (ppm), effective to significantly increase the high temperature creep resistance. An exemplary titanium aluminum alloy of the invention includes from about 900 ppm to about 1500 ppm oxygen to increase high temperature creep strength by 2 to 3 times or more.

A preferred titanium aluminide composition in accordance with the invention consists essentially of, in weight %, about 57 to about 66 Ti, about 30 to about 34 Al alloyed with about 3 to 6 weight % of Nb and about 1 to about 3.5 weight % of Mn with oxygen present in the range of about 900 to about 1500 ppm.

The oxygen content of the titanium aluminum alloy can be controlled pursuant to a method embodiment of the present invention by appropriate selection of input or starting alloy materials or components and by addition of $TiO_2$ particulates to the melt.

The titanium aluminum alloy of the invention can be investment cast, hot isostactically pressed, and heat treated. In general, the heat treated titanium aluminide material of the invention exhibits significantly improved creep resistance and ultimate tensile strength without a substantial decrease in ductility at room temperature.

The heat treated microstructure comprises predominantly gamma (TiAl) phase and a minor amount of alpha two ($Ti_3Al$) phase.

The aforementioned objects and advantages of the invention will become more readily apparent from the following detailed description taken with the drawings.

DETAILED DESCRIPTION OF THE INVENTION

Figure 1:
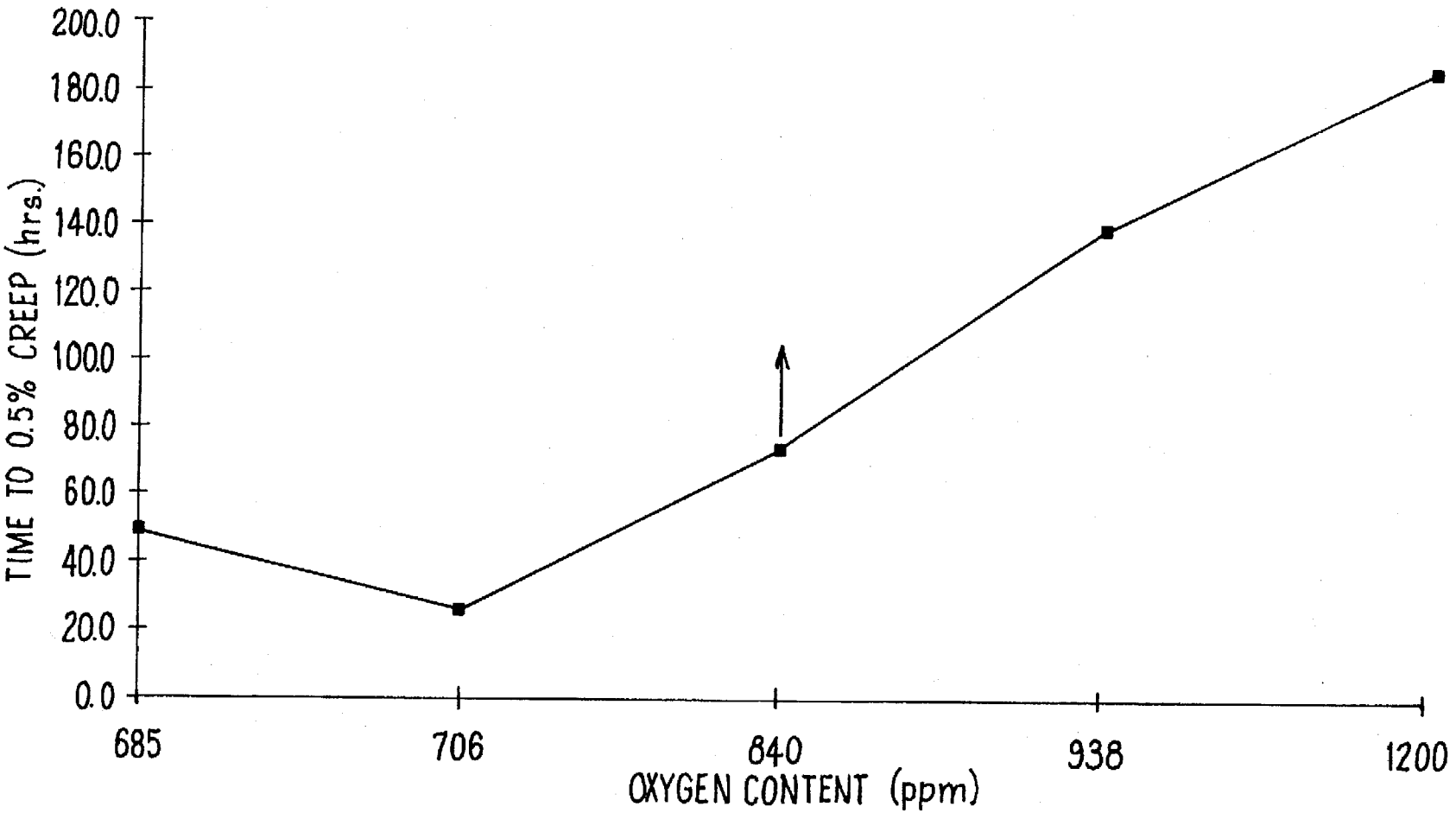
FIG. 1 is a graph of the oxygen content in ppm by weight versus time to 0.5% creep (in hours) at 1400 degrees F. and 20 ksi load for an exemplary titanium aluminide composition of the invention comprising 32 weight % Al 4.5 weight % Nb, 2.5 weight % Mn, and balance Ti with 0.8 volume % $TiB_2$ investment cast and heat treated at 1850 degrees F. for 50 hours.

The present invention provides in one embodiment a titanium aluminum alloy comprising titanium in the range of about 55 to about 71 weight % and aluminum in the range of about 29 to about 35 weight % and oxygen intentionally in the composition at a relatively high amount as compared to usual oxygen impurity levels effective to significantly increase high temperature creep resistance of the material. A typical titanium aluminum alloy composition of the invention includes greater than about 800 parts per million by weight (ppm) to this end as compared to usual oxygen impurity levels of about 400 to about 800 ppm in gamma titanium aluminide alloys. A preferred alloy composition includes oxygen from about 900 ppm to about 1500 ppm oxygen to increase high temperature creep strength by 2 to 3 times or more. In contrast, in the manufacture of gamma based titanium aluminide alloys pursuant to prior practice, oxygen impurity levels typically are maintained as low as possible and in the aforementioned range of about 400 to about 800 weight %.

The titanium aluminide alloy composition can include alloyants such as Nb, Mn, Cr, W, Mo, Si, and others and dispersoids such as $TiB_2$ and others for various purposes in addition to the intentional oxygen addition in an effective amount to increase high temperature creep resistance. For example, the invention envisions titanium aluminide compositions consisting essentially of, in weight %, about 57 to about 66 Ti, about 30 to about 34 Al alloyed with about 3 to about 6 weight % of Nb and about 1 to about 3.5 weight % of Mn with oxygen present in the range of about 900 to about 1500 ppm.

A particularly preferred titanium aluminide composition consists essentially of, in weight %, about 59.5 to about 63.5 Ti, about 31 to about 33 Al alloyed with about 4 to about 5 weight % of Nb and about 1.5 to about 2.5 weight % of Mn with oxygen present in the range of about 900 to about 1500 parts per million by weight.

For purposes of illustration and not limitation of the invention, a titanium aluminide alloy composition comprising 32 weight % Al, 4.5 weight % Nb, 2.5 weight % Mn, and balance Ti with 0.8 volume %. $TiB_2$ dispersoids was prepared as cylindrical specimen bars (dimensions of ⅝ inch diameter and length of 8 inches) by vacuum arc melting a master heat of the alloy composition that included 0.8 volume % $TiB_2$ dispersoids pursuant to U.S. Pat. Nos. 5 284 620 and 5 429 796, the teachings of which are incorporated herein by reference to this end. Other melting techniques such as vacuum induction melting and induction skull melting also can be used to melt the master heat. The dispersoids can be provided in the master heat by adding an appropriate amount of a 95 weight % Ti-5 weight % B alloy to the heat.

The master heat was melted at less than 20 microns atmosphere and then cast at a superheat of about 75 degrees F. into an investment mold having a facecoat comprising yttria. The oxygen content of the specimen bars was controlled by selection of input or starting materials and by addition of fine $TiO_2$ powder to the melt to provide oxygen concentrations of 685, 706, 840, 938, and 1200 ppm by weight for creep testing. The $TiO_2$ powder was provided in the melt by addition after a melt pool was formed.

The as-cast microstructures of the specimen bars having the aforementioned oxygen contents were similar and comprised a lamellar structure containing laths of gamma phase and alpha-two phase.

Test specimens for creep testing and tensile testing were machined from from the cast specimen bars. The creep test specimens were machined and tested in accordance with ASTM test standard E8. The tensile test specimens were machined and tested in accordance with ASTM test standard E8.

Before machining, the cast test specimens were hot isostactically pressed at 2300 degrees F. and argon pressure of 25 ksi for 4 hours. Then, the test specimens were heat treated at 1850 degrees F. for 50 hours in an argon atmosphere and allowed to furnace cool to ambient by furnace power shutoff.

The heat treated microstructures of the test specimens having the aforementioned oxygen contents were similar with both lamellar and equiaxed grains and comprised predominantly gamma phase (TiAl) and a minor amount (e.g. 5 volume %) of alpha-two phase.

Heat treated specimens were subjected to steady state creep testing in accordance with ASTM test standard E8 at 1400 degrees F. and test stress of 20 ksi. The time to reach 0.5% elongation was measured.

The average time to reach 0.5% elongation typically for 2–3 specimens is shown in FIG. 1 for the specimens having the aforementioned oxygen concentrations.

It is apparent from FIG. 1 that at oxygen concentrations between about 685 and 706 ppm, the time to 0.5% elongation was reduced by the presence of these oxygen levels. The test specimens having 685 ppm oxygen are representative of typical oxygen impurity levels encountered in the manufacture of gamma based titanium aluminide alloys.

However, for oxygen concentrations greater than about 706 ppm, the time to 0.5% elongation unexpectedly and significantly increased with increased oxygen concentration in the manner shown in FIG. 1. At oxygen concentrations in the range of about 900 ppm, the time to 0.5% elongation was at least doubled from about 50 minutes to about 100 minutes. At oxygen concentrations of more than about 950 ppm, the time to 0.5% elongation was at least tripled from 50 hours to 150 hours. The time to 0.5% elongation at 1200 ppm oxygen was above 180 hours.

Pursuant to the invention, an oxygen concentration above about 800 ppm and preferably from about 900 to about 1500 ppm is preferred to substantially increase creep resistance of the predominantly gamma titanium aluminide alloy. Oxygen concentrations above 1500 ppm are less preferred since alloy ductility is adversely affected.

Heat treated specimens also were subjected to tensile testing in accordance with ASTM test standard E8 at room temperature and at 1200 and 1247 degrees F.

The ultimate tensile strength (UTS), yield strength (YS), and elongation are set forth below in the Table:

TABLE

| | Tensile Properties | | | |
|---|---|---|---|---|
| Test Temp. (°F.) | Tensile Strength (KSI) | 0.2% Offset Yield Strength (KSI) | Elong. (%) | O2 Level (ppm) |
| RT | 65.2 | 55.8 | 0.85 | 1200 |
| " | 70.0 | 60.2 | 0.83 | 938 |
| " | 65.4 | 57.6 | 0.75 | 843 |
| " | 75.0 | 65.5 | 0.85 | 685 |
| 1200 | 66.3 | 48.9 | 2.1 | 1200 |
| " | *76.7 | 50.4 | 4.4 | 938 |
| " | 70.0 | 47.4 | 3.4 | 843 |
| " | 78.8 | 55.0 | 3.3 | 685 |

*Testing conducted at 1247° F.

It is apparent that the inclusion of oxygen concentrations in amounts to substantially increase creep resistance did not substantially adversely affect elongation at room temperature and at 1200 degrees F.

Although the present invention has been described in detail herabove with respect to certain embodiments for purposes of illustration, the invention is not so limited and modifications and changes can made therein within the scope of the appended claims.

I claim:

1. Titanium aluminum alloy comprising titanium in the range of about 55 to about 71 weight % and aluminum in the range of about 29 to about 35 weight % having a predominantly gamma titanium aluminide microstructure wherein oxygen is intentionally included in an amount greater than about 800 parts per million by weight to increase high temperature creep resistance.

2. The alloy of claim 1 wherein the oxygen content is from about 900 ppm to about 1500 ppm oxygen.

3. The alloy of claim 1 including $TiB_2$ dispersoids.

4. Predominantly gamma titanium aluminide alloy consisting essentially of, in weight %, about 57 to about 66% Ti, about 30 to about 34% Al, about 3 to about 6% Nb and about 1 to about 3.5% Mn with oxygen present in the range of about 900 to about 1500 parts per million by weight to increase high temperature creep resistance.

5. Predominantly gamma titanium aluminide alloy consisting essentially of, in weight %, about 59.5 to about 63.5% Ti, about 31 to about 33% Al, about 4 to about 5% Nb and about 1.5 to about 2.5% Mn with oxygen present in the range of about 900 to about 1500 parts per million by weight to increase high temperature creep resistance.

6. A predominantly gamma titanium aluminide article comprising titanium in the range of about 55 to about 71 weight % and aluminum in the range of about 29 to 35 weight % wherein oxygen is intentionally included in the article in an amount greater than about 800 parts per million by weight effective to increase high temperature creep resistance of the article.

7. The article of claim 6 wherein the oxygen content is from about 900 ppm to about 1500 ppm oxygen.

8. The article of claim 6 in the heat treated condition.

9. The article of claim 6 including $TiB_2$ dispersoids.

10. A predominantly gamma titanium aluminide article consisting essentially of, in weight %, about 57 to about 66% Ti, about 30 to about 34% Al, about 3 to about 6% Nb and about 1 to about 3.5% Mn with oxygen present in the range of about 900 to about 1500 parts per million by weight to increase high temperature creep resistance.

11. The article of claim 10 in the heat treated condition.

12. The article of claim 10 including $TiB_2$ dispersoids.

13. The article of claim 10 comprising a creep resistant gas turbine engine component.

14. A method of making a titanium aluminide material having improved high temperature creep resistance, comprising forming a melt consisting essentially of about 55 to about 71 weight % Ti and about 29 to about 35 weight % Al and adding an oxygen-containing material to the melt to control the oxygen content thereof in an amount greater than about 800 parts per million by weight to increase high temperature creep resistance of predominantly gamma titanium aluminide solidified from said melt.

15. The method of claim 14 wherein $TiO_2$ particulates are added to the melt.

* * * * *